United States Patent [19]

Auer

[11] Patent Number: 4,665,828

[45] Date of Patent: May 19, 1987

[54] PENETRATOR FOR A DRIVING-CAGE PROJECTILE AND THE PROCESS OF MANUFACTURING THE SAME

[75] Inventor: Ekkehard Auer, Linz, Austria

[73] Assignee: Voest-Alpine Aktiengesellschaft, Linz, Austria

[21] Appl. No.: 674,170

[22] Filed: Nov. 23, 1984

[30] Foreign Application Priority Data

| | | | |
|---|---|---|---|
| Nov. 23, 1983 | [AT] | Austria | 4114/83 |
| Apr. 19, 1984 | [AT] | Austria | 1323/84 |
| Apr. 19, 1984 | [AT] | Austria | 1324/84 |
| May 29, 1984 | [AT] | Austria | 1774/84 |

[51] Int. Cl.[4] ..... F42B 11/12; B22F 7/06

[52] U.S. Cl. ..... 102/519; 102/520; 419/6; 419/7; 419/28; 419/29

[58] Field of Search ..... 102/517–523; 419/5, 6, 7, 28, 29, 43

[56] References Cited

U.S. PATENT DOCUMENTS

| | | | |
|---|---|---|---|
| 2,393,648 | 1/1946 | Martin | 102/519 |
| 2,435,095 | 1/1948 | Nichols | 102/519 |
| 2,922,366 | 1/1960 | Lyon | 102/519 |
| 3,302,570 | 2/1967 | Marguardt | 102/519 |
| 3,746,581 | 7/1973 | Cairns et al. | 419/29 |
| 3,880,083 | 4/1975 | Wasserman et al. | 102/519 |
| 4,428,295 | 1/1984 | Urs | 102/517 |
| 4,458,599 | 7/1984 | Mullendore et al. | 419/28 |
| 4,524,695 | 6/1985 | Bisping et al. | 102/520 |

*Primary Examiner*—Deborah L. Kyle
*Assistant Examiner*—T. J. Wallen
*Attorney, Agent, or Firm*—Cushman, Darby & Cushman

[57] ABSTRACT

The invention relates to a penetrator (1, 11) made of heavy metal, such as, for instance, tungsten heavy metal or depleted uranium, for driving-cage projectiles which have the penetrator led by the driving cage in the gun barrel. The driving cage (6, 12) detaches itself from the penetrator after the launch. The penetrator (1, 11) shows lower strength and higher ductility in the middle portion (d) of its length than in its head portion (c) and, in its tail portion, it shows higher strength and lower ductility than in its middle portion (d) and lower strength and higher ductility than in its head portion (c). This shall decrease the risk of fracture when striking an armour. The varying strength values in the head portion (c), in the middle portion (d) and in the tail portion (e) are obtained by cold-hammering under varying degrees of deformation, by sintering from various powder mixtures or by varying partial heat-treatment in the various portions (head portion c, middle portion d and tail portion e), and these measures can be applied individually or in combination. At least one pilot core (14, 15) which is only loosely connected to the penetrator (1, 11) can also be fitted to the head portion.

24 Claims, 5 Drawing Figures

PENETRATOR FOR A DRIVING-CAGE PROJECTILE AND THE PROCESS OF MANUFACTURING THE SAME

The invention relates to a penetrator essentially consisting of heavy metal such as, for instance, tungsten heavy metal or uranium, in particular depleted uranium, for a driving-cage projectile with a driving cage that encircles the penetrator and whose diameter is larger than that of the penetrator, with the latter being essentially built in one piece from its head portion to its tail portion and optionally with a guiding device being connected to the tail portion of the penetrator, and to a process of manufacturing such a penetrator. Depleted uranium is natural uranium depleted in $235_U$ as it comes as a residue in upgrading natural uranium. In such projectiles the penetrator, which has essentially the form of an arrow and a much smaller diameter than the gun barrel, is encircled by a diametrally larger driving cage, also termed cartridge-case base, through which the projectile in the gun barrel is led. Behind the barrel muzzle the driving cage is released from the penetrator. Since the area affected by the propellant charge is considerably enlarged by the driving cage, it is possible to transfer a very great propelling force to the penetrator. The exhaust velocity of the pentrator at the end of the gun barrel can amount to 1000–3500 m/s.

Since the penetrator consists of heavy metal, its ram effect is very great, and such penetrators therefore have an armour-crushing effect. For this purpose the penetrator has to be very strong and hard. But this great strength, which enables the penetrator to penetrate the armour, entails great brittleness. Especially in bulk-headed armours intermittent forces develop when the penetrator penetrates the armour and, in view of the brittleness of the material of the penetrator, bring about a risk of fracture.

It turned out that the shaft of the penetrator often breaks then. In this case the kinetic energy of the rear part of the shaft of the penetrator gets lost and the head of the penetrator does not penetrate the armour.

It is the task of the invention to reduce the risk of fracture of a penetrator thus improving the effect of its penetration.

The gist of the invention is that the penetrator has lower strength and higher ductility in the middle portion of its length than in its head portion and that in its tail portion strength is higher and ductility lower than in its middle portion while strength is lower and ductility higher than in its head portion.

The strength of the head—the greater the strength the greater the hardness—is essential for the penetrating of the penetrator into an armour and this strength is maintained. With the regular penetrators the risk of fracture was mainly for the middle portion of the penetrator. Since this middle portion has now lower strength according to the invention and therefore shows higher ductility a risk of fracture is avoided or at least reduced in this portion. Thus it is guaranteed that the kinetic energy of the rear part of the penetrator is maintained for the penetration effect and a penetration of the penetrator through the entire armour is enhanced at least. Because the tail portion of the penetrator is more ductile than the head portion, the risk of fracture is reduced in the tail portion as well. At the launch the tail of the penetrator is subjected to extremely high strain by the accelerating power. This is taken into account by the tail portion of the penetrator having a higher strength than its middle portion. All in all the high strength of the head portion thus guarantees the penetration of the penetrator into the armour, by avoiding a risk of fracture in the middle and tail portions the mass of the entire penetrator is utilized for its penetrating the armour and by the sufficient strength of the tail portion the strain by the propellant charge at the launch is accounted for.

According to a preferred design of the invention the strength values decrease continually from the head to the middle portion, with the strength values continually increasing from the middle portion to the tail appropriately. Abrupt transitions of the strength values along the penetrator are thus avoided, a fact that also works to reduce the risk of fracture. According to an advantageous design of the invention the penetrator shows strength values up to 1100–2000 N/sq. mm in its head portion, with the strength values in its middle portion decreasing up to 900–600 N/sq. mm. Such a penetrator is particularly well adjusted to the strain.

Especially when the penetrator strikes the armour obliquely to the surface of the latter, a pitching moment or a lateral strain of the penetrator comes into effect. When the head of the penetrator has covered a first penetration distance into the armour, the head portion of the penetrator is blocked in the hole made into the armour and the pitching moment or lateral strain can lead to a fracture of the penetrator in the head portion, which has lower ductility, when the head of the penetrator is blocked after a first penetration distance in the armour. According to an advantageous design of the invention at least one pilot core can be connected to the head portion of the penetrator. It is this pilot core which penetrates the armour first. After having covered the first penetration distance the penetrator is therefore not blocked in the hole made, but only the pilot core or the pilot cores have penetrated the armour at the beginning of the penetration distance.

Owing to its inertia the penetrator persists in its direction, but nevertheless pitching moments occur, which cannot, however, lead to a fracture of the head portion of the penetrator, because the penetrator is not blocked in the hole. The pilot cores are separated from the penetrator without exerting a lateral moment to the penetrator. After a hole has been punched by means of the pilot cores, lateral forces do not occur at the further penetration of the penetrator. The pilot core is to penetrate the armour and, therefore, even the pilot core must have great strength. According to the invention the pilot core appropriately consists of the same material as the head portion of the penetrator and preferably has at least the same hardness as the head portion of the penetrator. Thus the piercing effect of the pilot cores is guaranteed.

According to the invention the pilot core is appropriately supported against the acceleration force at the front end of the penetrator. It is sufficient, if the pilot core is just captively put at the penetrator. But the pilot core shall be connected to the penetrator only so far that the connection suffices for the transport and the flight. The separation of the pilot core from the penetrator shall not be hindered by the connection, in order to avoid lateral moments. It is even sufficient to connect the pilot core to the penetrator by means of a rubber cord.

According to the invention the pilot core is appropriately covered by a streamlined cap or nose fastened at the front end of the penetrator. This cover is favourable for reasons of ballistics. According to the invention the cover can be, for instance, a streamlined cap of aluminum.

According to an advantageous design of the invention the streamlined cap is screwed on the front end of the penetrator, and the pilot core is supported at the cap under insertion of a rubber ring. The arrangement can be in such a way that at least two pilot cores are connected to the front end of the penetrator, with the front pilot core having a smaller diameter than the rear pilot core and with the rear pilot core having a smaller diameter than the front area of the penetrator, so that the rear pilot core is centered by a rim-band at a front area of the penetrator and the front pilot core by a rim-band at the front area of the rear pilot core and that the front pilot core is supported against the streamlined cap by the insertion of a rubber ring.

According to the invention a process of manufacturing such a penetrator of tungsten heavy metal consists essentially of molding and sintering the penetrator out of a powderlike mixture of tungsten heavy metal and additional metals, such as iron, nickel, manganese, copper, cobalt and molybdenum, manganese-iron alloy, one or more at the same time, with the share of additional metals being increased in those portions of the sinter form which correspond to the portions of lower strength of the penetrator. The larger share of tungsten heavy metal effects a higher strength, and the ductility can be increased by enlarging the share of the additional metals while reducing the share of tungsten heavy metal under abandoning the greater hardness. By a dosed filling of the powder parts into the sinter form the ductility in the middle portion of the length of the penetrator can thus be increased and the strength in the head portion and also in the tail portion can be increased accordingly, with even the transitions of strength and ductility between the individually different portions being possible without any difficulty. According to the invention the additional metals may also comprise micro-alloys of the elements cobalt and molybdenum, one or more of them, in a quantity of 0.00001–1 percent. At one preferred design of the process of the invention the mixture contains 90–99 percent of tungsten heavy metal, the rest being additional metals, with the higher tungsten quantities given to the portions of the higher strength of the penetrator. The sinter body can be press-forged or die-pressed and afterwards subjected to a usual sinter temperature of 1100°–1700° C. Sintering is done here either in the vacuum or under protective atmosphere, such as in an atmosphere of dry hydrogen, dissociated ammonia, nitogen or inert gases or mixtures of the same.

According to the invention a further process of manufacturing such a penetrator of tungsten heavy metal is to cold-hammer the penetrator, with a higher degree of deformation in the portions of higher strength and lower ductility than in the portions of higher ductility and lower strength. Preferably, the penetrator is cold-hammered from a blank part which, before being hammered, shows a larger starting diameter in those portions that correspond to the portions of higher strength of the penetrator than the diameter in the portions which correspond to the portions of lower strength of the penetrator. The hammered penetrator has essentially the same diameter along its length. Because of the fact that the blank part has now a large diameter in the portions of higher strength than in the areas of lower strength, the degree of deformation is higher in the portions in which higher strength shall be obtained and by this higher deformation degree the strength in these portions is increased at the cold forming. Thus it is, for instance, possible according to the invention that the cold-hammering of the head portion of the penetrator is done with a deformation degree up to 30 percent and the cold-hammering of the middle and tail portions of the penetrator with a deformation degree of 0–20 percent. According to the invention the penetrator may, for instance, be cold-hammered in its head portion with a deformation degree of 6–20 percent, in its middle portion with a deformation degree of 2–12 percent, and in its tail portion with a deformation degree of 4–16 percent.

According to the invention one may use a blank part homogenous along its length, of a homogenous alloy of 90–99 percent tungsten heavy metal, the rest being iron, nickel, copper, manganese, cobalt, molybdenum, one or more at the same time. In this case the differences in strength are obtained by the deformation degree only.

According to the invention a sintered blank part which is cold-hammered with varying deformation degrees in the portions of its varying composition can also be used. When cold-hammering is carried out with a higher deformation degree in the portions of the blank part which have a larger share of tungsten heavy metal and a smaller share of additional metal, higher strength is achieved by the alloy composition and the deformation degree. According to the invention the penetrator shall appropriately be subjected to an annealing heat treatment at 800°–1550° C.

In a process of manufacturing the penetrator of depleted uranium the varying strength values in the various portions can be produced by partial heat treatment varying in these portions. In this case the penetrator is made of a uranium alloy containing about 0.7 percent titanium and partially heat-treated at a temperature of 400°–600° C., preferably 400°–500° C., in the head portion, at a temperature of 180°–300° C., preferably 180°–220° C. in the middle portion, and a temperature of 350°–450° C., preferably 350°–400° C., in the tail portion, at an advantageous design. At another advantageous design of the invention the penetrator is made of a depleted uranium-alloy containing about 2 percent molybdenum, and partially heat-treated at a temperature of 350°–400° C. in the head portion, a temperature of 520°–670° C., preferably 520°–570° C. in the middles portion, and a temperature of 400°–550° C., preferably 400°–450° C. in the tail portion. Gradual transitions between the portions of varying strength may occur here. The blank part of the respective uranium-alloy may be cast or sintered in this case.

According to the invention even a penetrator of depleted uranium can be further compacted by cold forming. Thus, analogously to a tungsten-heavy-metal penetrator, a uranium penetrator can be cold-hammered out of a uranium blank part composed and heat-treated according to the invention. This uranium blank part must have a larger diamter in the portions which correspond to the portions of higher strength of the penetration than in the portions which correspond to the portions of lower strength of the penetrator. In such a penetrator of depleted uranium cold-hammering in the head portion of the penetrator can be done with a deformation degree up to 30 percent and cold-hammering in the middle and tail portions of the penetrator with a deformation degree of 2–12 percent. Appropriately, cold-hammering in the head portion is done with a deformation degree of 6–20 percent, in the middle portion with a deformation degree of 2–12 percent and in the tail portion with a deformation degree of 4–16 percent. In a uranium penetrator treated in this way, in particular one of depleted uranium, strength values of, e.g., 1700 N/sq. mm in the head portion, of 1450 N/sq. mm in the tail portion and 1200 N/sq. mm in the middle portion can be achieved. Because of the lower strength values in the middle portions the ductility is higher there.

According to an advantageous design of the invention the penetrator consisting of uranium, in particular of depleted uranium, is heat-treated under a temperature of 300°–800° C. after cold-hammering. By such a heat-treatment, which is also called subcritical annealing, gradual transitions between the portions of varying strength can be obtained and in this way metallurgical indents between these portions are avoided.

The invention is schematically explained in the drawing.

Figure 1:
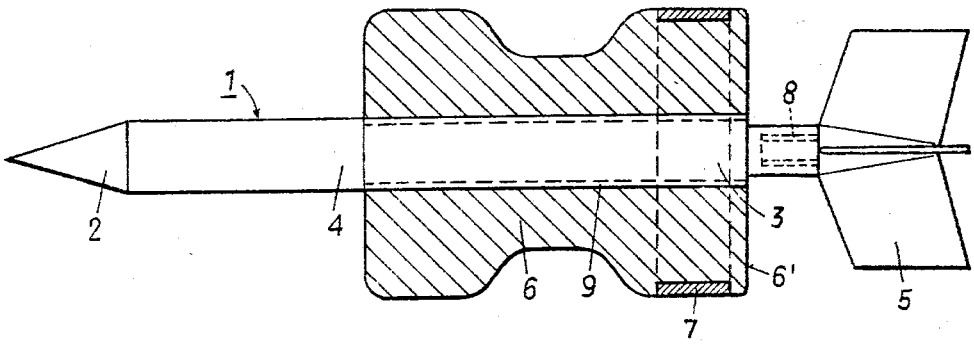
FIG. 1 shows an example of driving-cage projectile with penetrator and driving cage, with the penetrator depicted in axial section.

FIG. 1 shows a driving-cage projectile. Penetrator 1 has a head 2, a tail 3 and a middle part 4. Annexed to tail 3 there is a guiding device 5 which is formed of wings of a specifically light material, e.g. aluminum, and which leads to a stabilisation during flight. This guiding device 5 may, for instance, be screwed into a thread 8 of the penetrator. In its middle part 4 penetrator 1 is equipped with a screw thread 9 or grooves upon which a driving cage 6 is fixed. This driving cage 6 is led in the gun barrel and can have leading rings 7. The propellant charge of the gun acts on the rear face area 6' of this driving cage and on tail 3 of the penetrator. After leaving the barrel driving cage 6 is detached from the penetrator and penetrator 1 keeps flying on its own. Penetrator 1 consists of heavy metal, which increases its ram effect.

Figure 2:
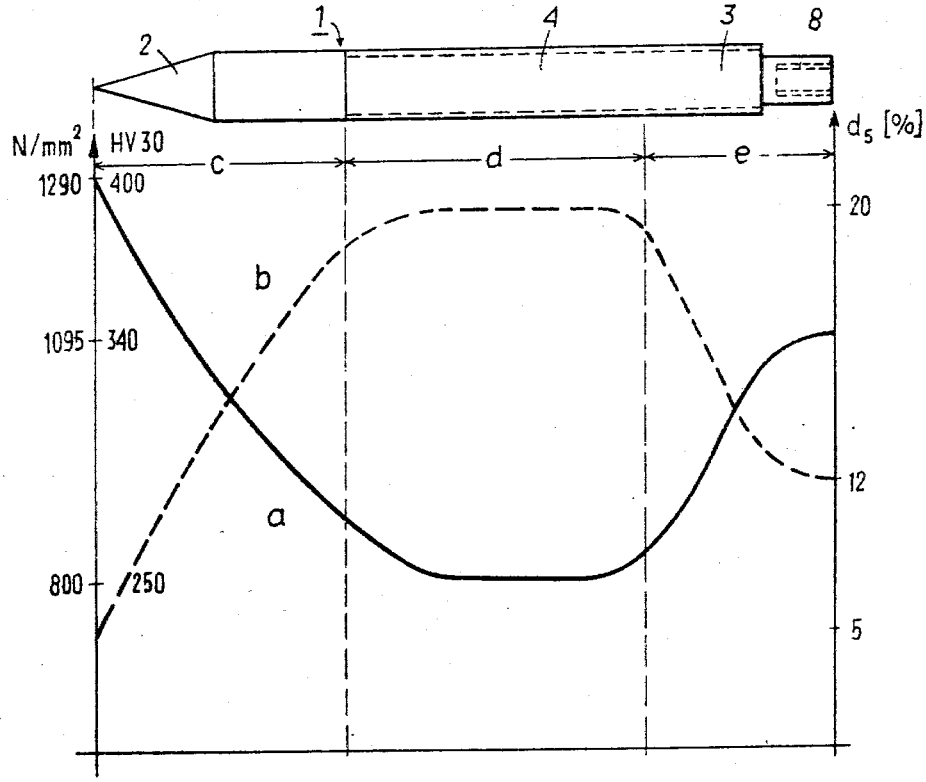
FIG. 2 shows a diagram of strength and ductility of a penetrator along its length.

FIG. 2 shows the strength diagram of a penetrator 1 built of tungsten heavy metal or uranium. Along the length of penetrator 1 the values for the strength in N/sq. mm and the Vickers pyramid hardness $HV_{30}$ are stated on the left ordinate. The ductility (ductile-yield values $d_5$ in percent) is stated on the right ordinate. The fully drawn curve a shows the strength and the Vickers pyramid hardness and the curve drawn with a broken line b shows the ductile yield in the various portions of the length of penetrator 1. The head portion is marked with c, the middle poriton with d and the tail portion with e. In the embodiment of the drawing the strength on head 2 reaches a value of 1290 N/sq. mm, which corresponds to a Vickers pyramid hardness $HV_{30}$ of 400.

Over the head portion c the hardness is decreasing from head 2 and reaches a value of 800 N/sq. mm in the middle portion d, which corresponds to a Vickers pyramid hardness $HV_{30}$ of 250. Coming from middle area d the strength is again increasing in the tail portion e and reaches a value of 1095 N/sq. mm at tail 3, which corresponds to a Vickers pyramid strength $HV_{30}$ of 340. The ductile yield (curve b) is 2–3 percent at the head and is increasing in the head portion c to the middle portion d. In the middle portion d the ductile yield is 20 percent. From the middle portion d the ductile yield again decreases over the tail portion e and reaches a value of 12 percent on tail 3.

Figure 3:
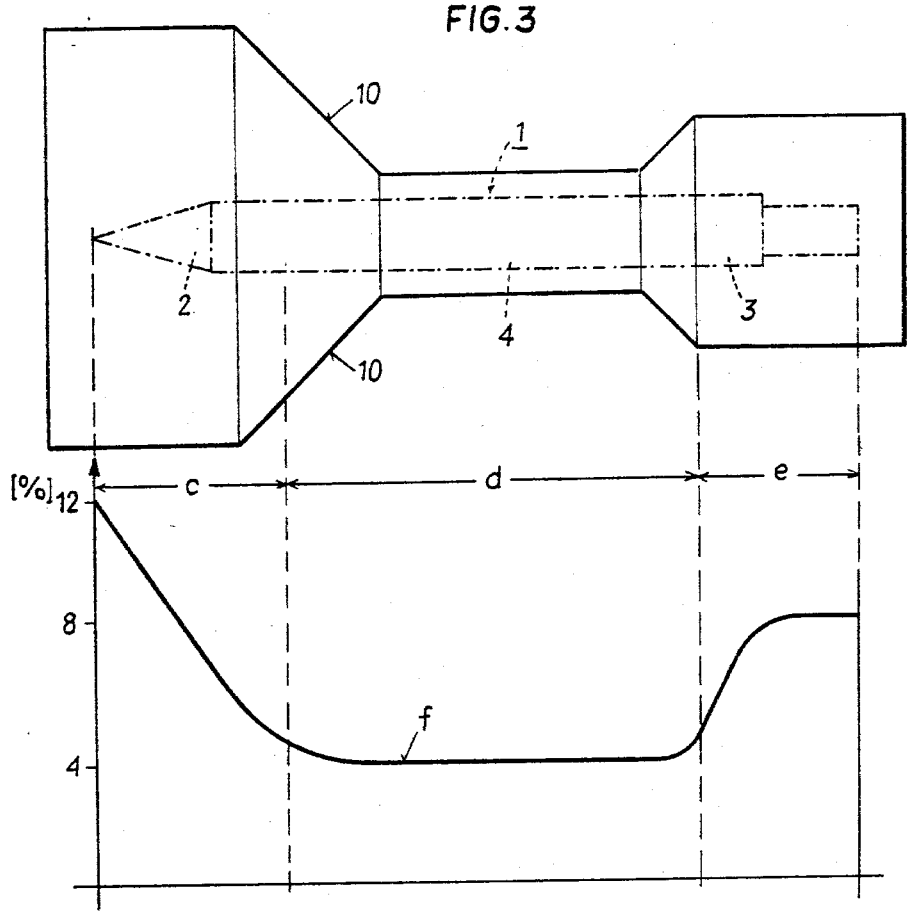
FIG. 3 shows an example of the cold-hammering of a penetrator with a diagram of the forging grade along the length of the penetrator.

FIG. 3 shows the cold-hammering of a blank part, e.g. of tungsten heavy metal. Since the completed penetrator 1 shall have an equal diameter over its length, a blank part is used which has a larger diameter in the portions in which a larger degree of forging or degree of deformation shall be obtained than in the portions in which only a lower degree of forging or degree of deformation shall be obtained. Lines 10 signify the outline of the blank part in the head portion c, middle portion d and tail portion e, with the differences of the diamenter of the blank part being depicted exaggeratedly for the sake of clearness. Within the lines 10 the penetrator 1 is shown, whose head is again marked with 2, whose tail is marked with 3 and whose middle is marked with 4. This blank part is cold-hammered and curve f shows the degree of forging or the degree of deformation. In the performance example of the drawing the forging degree is 12 percent at head 2. In portion c the forging degree is decreasing and amounts to 4 percent in the middle area d. Coming from the middle portion d the forging degree is increasing in the tail portion e and amounts to 8 percent at the tail 8.

Figure 4:
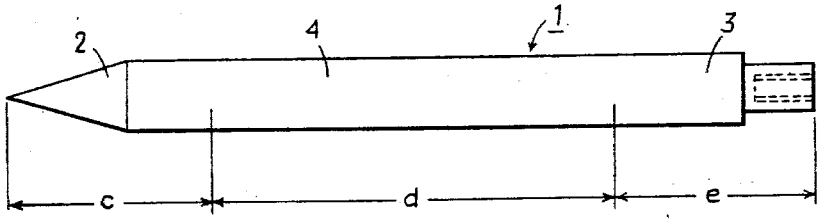
FIG. 4 shows a penetrator made of uranium-alloys.

FIG. 4 shows a penetrator made of an alloy of depleted uranium. With a uranium alloy containing 0.7 percent titanium, heat-treatment in this performance example is done 450° C. in the head portion c, at 200° C. in the middle portion d and at 370° C. in the tail portion e. With a penetrator of a uranium alloy containing 2 percent molybdenum, e.g., heat-treatment in the head portion c is done at 370° C., in the middle portion d at 550° C. and in the tail portion e at 430° C.

Figure 5:
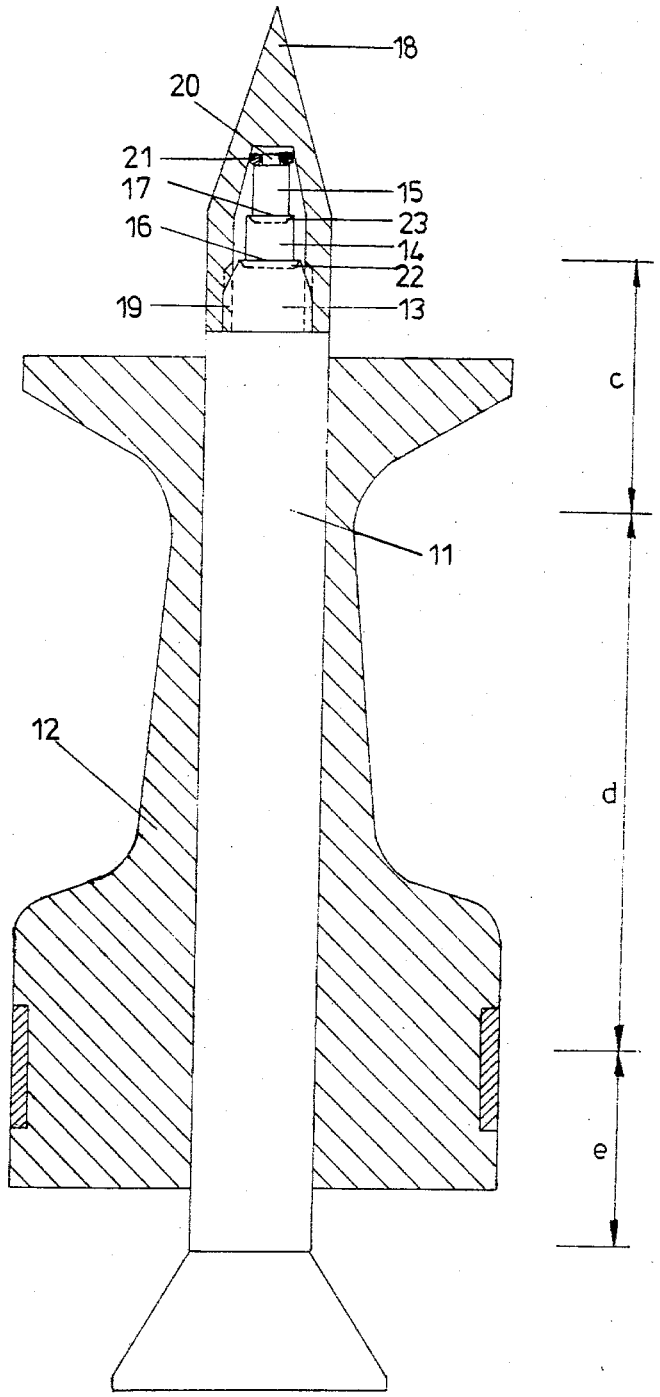
FIG. 5 shows a penetrator with pilot core.

FIG. 5 shows a penetrator with pilot core. 11 is the penetrator and 12 is the driving cage. To the front end 3 of the penetrator two pilot cores 14 and 15 are fitted. These pilot cores are supported against an area 16 which is perpendicular to the axis of penetrator 11. 18 is a streamlined cap of aluminum which is screwed upon front end 13 of the penetrator by means of athread 19. The second pilot core 15 has a centrical stud 20 surrounded by a rubber ring 21, e.g. an O-ring. By means of this rubber ring 21 the pilot cores 14 and 15 are supported against cap 18 and in this way the pilot cores 14 and 15 are held on penetrator 11 during the transport of the projectile and during the flight of the same. The supporting area 16 of penetrator 11 and the supporting area 17 of the first pilot core 14 having a protruding rim-band 22 or 23, so that pilot core 14 is centered against the front end 13 of the penetrator and the second pilot core 15 against the first pilot core 14.

I claim:

1. A penetrator comprising a body consisting of heavy metal selected from the group tungsten heavy metal, uranium and depleted uranium, for use in a driving cage, said body being built in one piece from its head portion to its tail portion, wherein said body has lower strength and higher ductility in a middle portion of its length than in its head portion and wherein in its tail portion it has higher strength and lower ductility than in its middle portion but lower strength and higher ductility than in its head portion.

2. A penetrator as in claim 1 including at least one pilot core connected to the head portion of said body.

3. A penetrator as in claim 2 wherein the pilot core consists of the same material as the head portion of said body.

4. A penetrator as in claim 2 wherein the pilot core has at least the same hardness as the head portion of said body.

5. A penetrator as in claim 2 wherein the pilot core is abutted against the acceleration force at the front end of said body.

6. A penetrator as in claim 2 wherein the pilot core is covered by a streamlined cap fastened to the front end of said body.

7. A penetrator as in claim 6 in the streamlined cap is made of aluminum.

8. A penetrator as in claim 6 wherein the streamlined cap is screwed to the front end of said body and wherein the pilot core is supported at the cap under insertion of a rubber ring.

9. A penetrator as in claim 6 wherein there are at least two pilot cores connected to the front end of said body, with the front pilot core having a smaller diameter than the rear pilot core and the rear pilot core having a smaller diameter than the front area of said body, wherein the rear pilot core is centered by a rim-band at the front area of said body and the front pilot core is centered by a rim-band at the front area of the rear pilot core, and wherein the front pilot core is supported against the streamlined cap under insertion of a rubber ring.

10. A process of manufacturing the body of a penetrator as in claim 1 comprising cold hammering the body, with a higher degree of deformation in the portions of higher strength and lower ductility than in the portions of higher ductility and lower strength.

11. A process as in claim 10 wherein the body is cold hammering from a blank part which has a larger diameter in the portions corresponding to the portions of higher strength of the body than in the portions corresponding to the portions of lower strength of the body.

12. A process as in claim 10 wherein cold hammering in the head portion of the body is performed with a deformation degree of up to 30 percent and cold hammering in the middle and tail portions of the body is performed with a deformation degree of 0–20 percent.

13. A process as in claim 10 wherein cold hammering in the head portion of the body is performed with a deformation degree of 6–20 percent, in the middle portion with a deformation degree of 2–12 percent and in the tail portion with a deformation degree of 4–16 percent.

14. A process as in claim 10 wherein a blank part is used that is homogenous along its length and that consists of a homogenous alloy of 90–99 percent of tungsten heavy metal, the rest being selected from the group consisting of iron, nickel, copper, manganese, cobalt, molybdenum, one or more at the same time.

15. A process as in claim 10 wherein the body is subjected to an annealing heat treatment at 800°–1550° C.

16. A process of manufacturing the body of a penetrator as in claim 1 out of depleted uranium, comprising subjecting the body to a varying partial heat treatment in the portions of varying strength.

17. A process as in claim 16 wherein the body is made of a uranium alloy containing about 0.7 percent titanium and wherein the body is partially heat-treated at a temperature of 400°–600° C. in the head portion, at a temperature of 180°–300° C. in the middle portion and at a temperature of 350°–450° C. in the tail portion.

18. A process as in claim 16 wherein the body is made of a uranium alloy containing about 0.7 percent titanium and wherein the body is partially heat-treated at a temperature of 400°–500° C. in the head portion, at a temperature of 180°–220° C. in the middle portion and at a temperature of 350°–400° C. in the tail portion.

19. A process as in claim 16 wherein the body is made of an alloy of depleted uranium containing about 2 percent molybdenum and wherein the body is partially heat-treated at a temperature of 350°–400° C. in the head portion, at a temperature of 520°–670° C. in the middle portion and at a temperature of 400°–550° C. in the tail portion.

20. A process as in claim 16 wherein the body is made of an alloy depleted uranium alloy containing about 2 percent molybdenum and wherein the body is partially heat-treated at a temperature of 350°–400° C. in the head portion, at a temperature of 520°–570° C. in the middle portion and at a temperature of 400°–450° C. in the tail portion.

21. A process as in claim 16 including cold hammering the head portion of the body with a deformation degree of up to 30 percent and cold hammering in the middle and tail portions of the penetrator with a deformation degree of 2–12 percent.

22. A process as in claim 16 including cold hammering in the head portion of the penetrator with a deformation degree of 6–20 percent, in the middle portion with a deformation degree of 2–12 percent and in the tail portion with a deformation degree of 4–16 percent.

23. A process as in claim 21 wherein the body is heat-treated at a temperature of 300°–800° C. after cold hammering.

24. A penetrator comprising a body of heavy metal selected from the group tungsten heavy metal, uranium and depleted uranium, for use in a driving cage, said body being built in one piece from its head portion to its tail portion, wherein said body has a high strength of 1100 to 2000 N/sq. mm and low ductility in its head portion, a lower strength of 600 to 900 N/sq. mm and higher ductility in a middle portion of its length and wherein in its tail portion it has higher strength and lower ductility than in its middle portion but lower strength and higher ductility than in its head portion, the strength values in said tail portion increasing from said middle portion up to 1300 N/sq. mm.

* * * * *